US005454261A

United States Patent [19]

Campian

[11] Patent Number: 5,454,261

[45] Date of Patent: Oct. 3, 1995

[54] HEMMING MACHINE AND METHOD OF OPERATION

[76] Inventor: Jon R. Campian, 1900 E. 14 Mile Rd., Madison Heights, Mich. 48071

[21] Appl. No.: 79,251

[22] Filed: Jun. 17, 1993

[51] Int. Cl.[6] ..... B21D 5/01

[52] U.S. Cl. ..... 72/384; 72/323; 72/454

[58] Field of Search ..... 72/323, 454, 384; 29/243.58

[56] References Cited

U.S. PATENT DOCUMENTS 3,830,615 8/1974 Walchhuetter ..... 72/454

FOREIGN PATENT DOCUMENTS 1322218 2/1963 France .
1445675 6/1966 France .
1192611 5/1965 Germany .

*Primary Examiner*—David Jones
*Attorney, Agent, or Firm*—Gifford, Krass, Groh, Sprinkle, Patmore, Anderson & Citkowski

[57] ABSTRACT

A hemming machine and method of operating the machine is presented in which a work supporting anvil is vertically positioned and driven in an impact stroke by an electric servo motor. A compound flanging and hemming die is mounted on a carriage for horizontal movement into and out of alignment with the anvil for successive formation of a flange and impacting the flange into a finished hem.

13 Claims, 6 Drawing Sheets

HEMMING MACHINE AND METHOD OF OPERATION

BACKGROUND OF THE INVENTION

1. Field of the Invention

The present invention relates to hemming machines, and, more particularly the invention relates to a sheet metal hemming machine utilizing a vertically movable anvil supporting the sheet metal part to be hemmed to impact against stationary dies which are moved into and out of impacting position.

2. General State of the Art

Typically sheet metal hemming machines utilize hydraulic cylinders for imparting vertical movement to the impacting punch or anvil. The vertical movement provided by these cylinders is often erratic, slowing down operation and causing inaccuracies, particularly where multiple cylinders are used.

Another major problem with the use of hydraulic cylinders is inevitable leakage and the attendant mess created.

Commonly, the sheet metal workpiece is supported on a stationary platen with vertically moving punches providing initial bending or flanging and hold down and also providing cam actuation of horizontally sliding punches, often requiring complex operating mechanisms with relatively slow sequential operation. Pivoting die carriers are sometimes used to simplify overall design.

SUMMARY OF THE INVENTION

The hemming machine of the present invention eliminates conventionally used hydraulic actuation and motor driven flywheel/clutch mechanisms for movement of the impacting punch member. The sheet metal part to be hemmed is supported on an anvil, and vertical movement of the anvil is obtained by the use of a controllable electric motor such as an AC or DC servo motor. In a preferred form of the invention, a DC servo motor moves a linear actuator such as a ball screw through a gear reducer to produce rapid torque and speed controlled movement of the anvil during its impact strokes and quick movement of the anvil during alignment. A flanging and hemming die is moved into and out of registry or alignment with the anvil so that with successive operation of the electric motor, the sheet metal part is impacted between the anvil and the pre-hemming or flanging portion of the die to form a semi closed hem or flange and the semi closed hem or flange is impacted between the anvil and the hemming portion of the die to form a closed hem.

In a preferred embodiment, a vertically moveable roller conveyor is used for movement between an upper load and discharge position above the anvil so that the sheet metal part can be loaded onto the roller conveyor and a lower position below the anvil. As the roller conveyor passes below the anvil, the sheet metal part is transferred from the roller conveyor to the anvil. The roller conveyor is also used to move the finished hemmed sheet metal part to its discharge point by movement of the roller conveyor from a position below the anvil to a position above the anvil, picking up the sheet metal part from the anvil.

Spaced AC or DC servo motors can be located for moving the anvil, and the hemming machine may include a number of flanging and hemming dies for movement into and out of registry with the anvil so that a number of flanges and subsequently a number of hems are simultaneously formed on the sheet metal part.

In the illustrated embodiment, an automotive part such as a hood having four previously formed flanges is supplied to the hemming machine of the present invention. An inner panel is then joined to the outer hood member by simultaneously pre-hemming the flanges and closing the flanges to form finished closed hems.

In a preferred embodiment of the invention, the dies are mounted on a horizontally movable carriage for sequentially shifting the flanging and hemming dies into alignment with the anvil for sequentially forming the flange and the hem on the sheet metal part. A compound die can be used having a flanging portion and a vertically spaced hemming portion. It should also be appreciated that more than two stages or two die components may be used. For example, two flanging or pre-hemming portions may be used.

In operation of the machine, the roller conveyor transfers the sheet metal part from a load position on the conveyor to the anvil. The compound die is moved horizontally to align the flanging portion of the die with the anvil, and the anvil is moved in an impacting stroke to impact the sheet metal part between the anvil and the flanging portion of the die. The compound die is then moved from its aligned work position to a rest position, and the anvil is moved vertically for alignment with the hemming die. When the hemming die is moved horizontally into its work position in alignment with the anvil, the anvil again is given a vertical impact stroke to impact the flange between the anvil and the hemming die. Finally the roller conveyor picks up the hemmed part from the anvil and moves it to a discharge position.

Other features and advantages of the present invention will become apparent to those skilled in the art when the following description of the best mode is considered for practicing the invention and is read in conjunction with the accompanying drawing, wherein like numerals refer to like or equivalent parts, and in which:

DETAILED DESCRIPTION OF THE PRESENTLY PREFERRED EMBODIMENTS OF THE INVENTION

Figure 1:
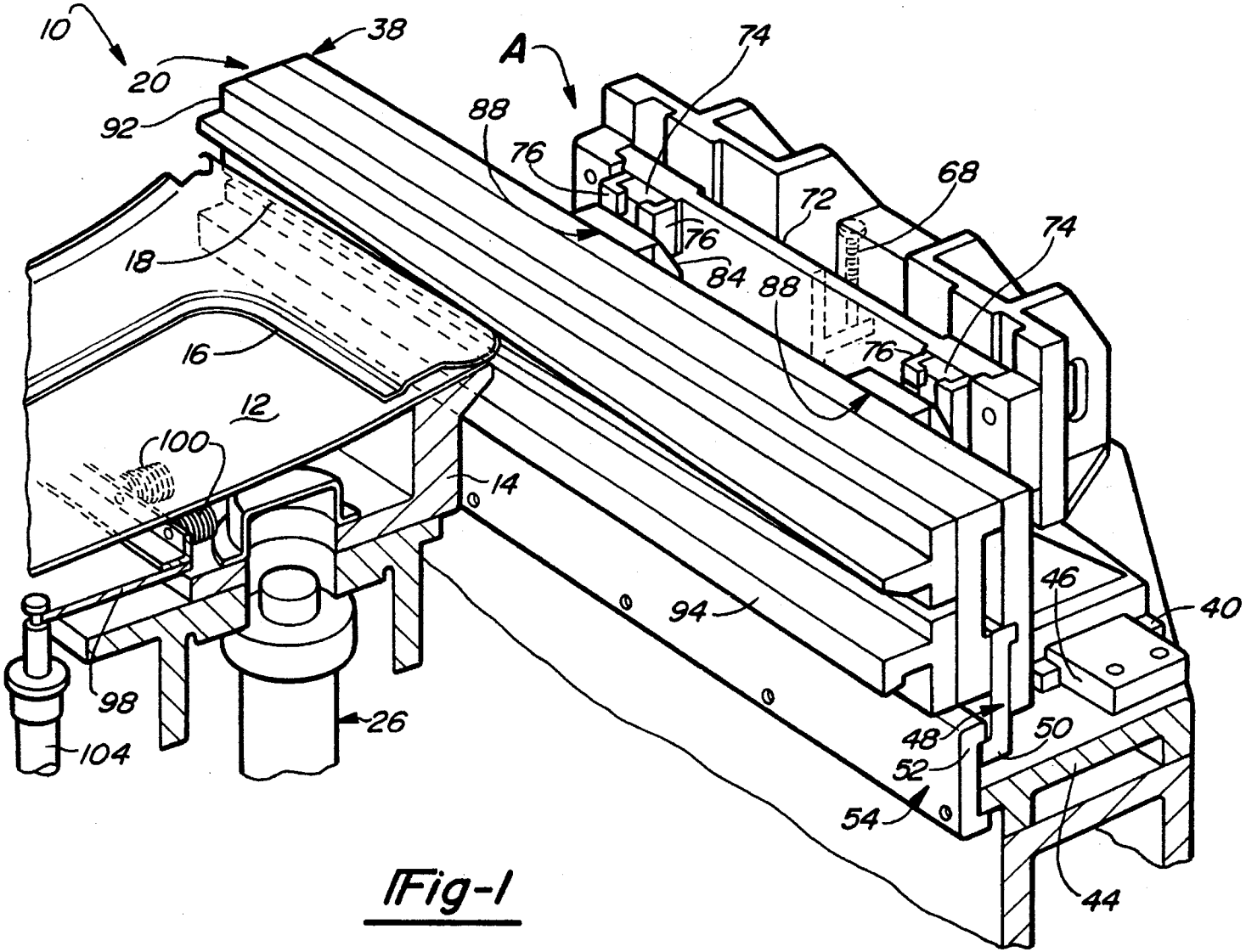
FIG. 1 is a perspective view showing the hemming machine of the invention with a horizontally movable compound flanging and hemming die and an anvil holding the sheet metal part to be hemmed; the anvil being vertically movable by an AC or a DC motor drive for impacting the anvil against the die.
Figure 2:
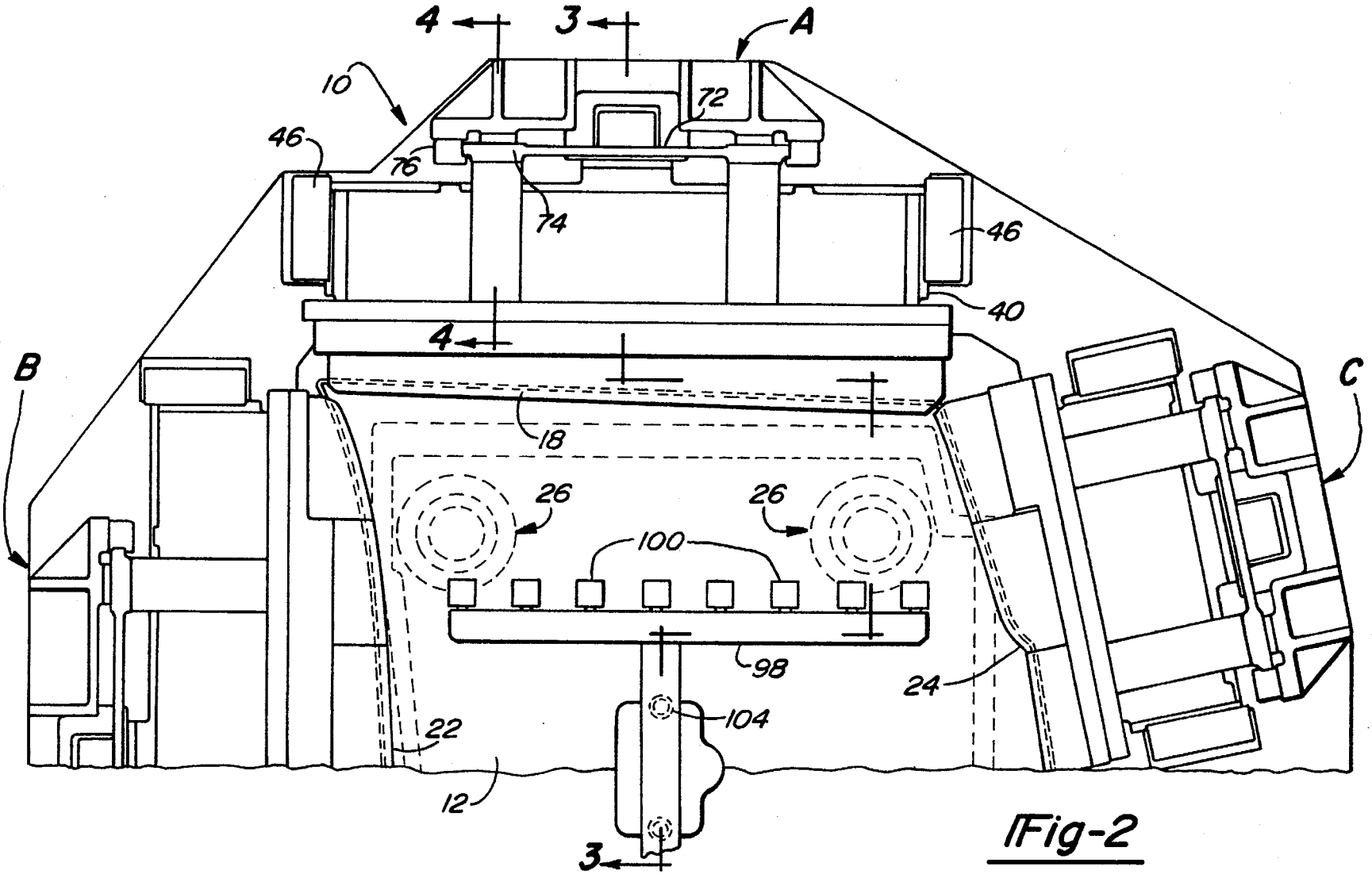
FIG. 2 is a partial plan view showing the full extent of one of the flanging and bending stations and a portion of two other flanging and bending stations of a machine providing hemming on four sides of a sheet metal part.
Figure 3:
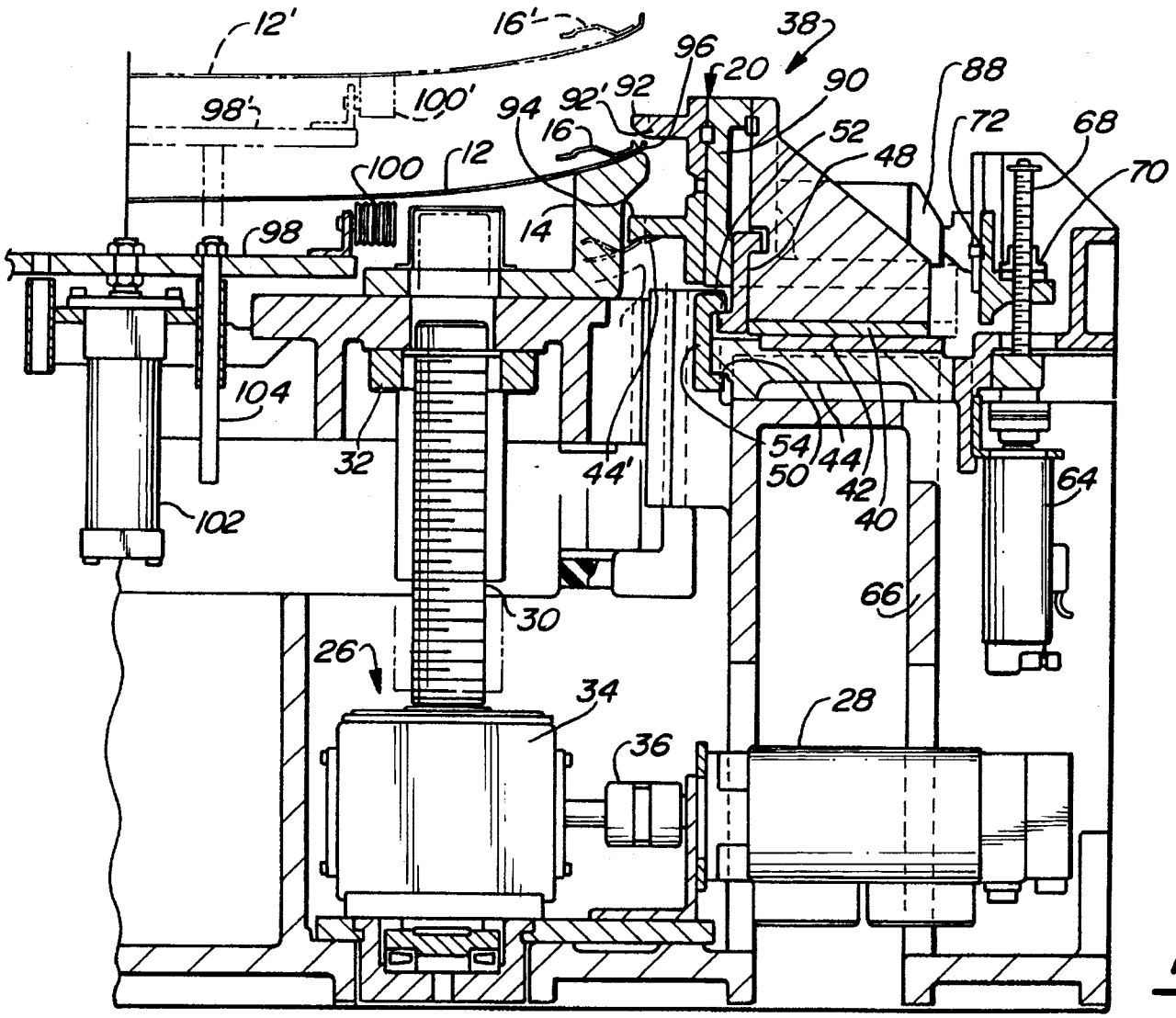
FIG. 3 is an elevational view partially in section taken along line 3—3 of FIG. 2.

Referring to FIGS. 1–3, portions of a bending machine according to the present invention is shown. The illustrated machine is capable of simultaneously forming four hems along the edges of a sheet metal part such as an automobile hood or door, joining the exterior panel to an interior panel or supporting frame structure. FIG. 1 shows a portion of a sheet metal outer hood panel 12 for a passenger car in position on an anvil 14 to be joined to an inner sheet metal panel 16 along one edge 18 being hemmed at bending station A.

As seen in FIG. 2, which depicts only the outer sheet metal panel 12 for clarity, the hemmed edge 18 being formed at station A is a relatively straight edge, although it is skewed relative to a central machine and part axis, requiring the compound die 20 to have a width constantly changing along its length as seen in FIG. 1. Curved hems 22 and 24 are being formed along the left and right edges of panel 12 at stations B and C as viewed in FIG. 2.

The anvil 14 is moved vertically for positioning and for effecting impact strokes through servo motor drives 26, each of which include a controllable electric motor 28, such as a DC servo motor and a linear actuator shown as a ball screw 30, the ball nut 32 of which is attached to anvil 14. Such controllable electric motors 28 enable the rotational position, as well as the number of revolutions, to be precisely controlled. The ball screw 30 is driven by gear reducing cone drive 34 from the servo motor 28 through coupling 36.

In the illustrated embodiment in which an automotive hood panel is being hemmed along four edges, a servo drive 26 is located at all four comers of the anvil as indicated by the two servo drives 26 shown in FIG. 2. Synchronization of the drives is accomplished by well known principles embodied in the power supply for DC servo motors 28. It has been found that a 2,000 rpm size 40s motor having a 9.4 horsepower rating is ideal for the illustrated application providing overall cycle times of 8–12 seconds as compared to a 21–30 second cycle time for hydraulic equipment. Using a conventional two stage hemming cycle with a prebend or flanging operation followed by hemming, the motors will deliver approximately 17,000 pounds of force for the flanging operation and a 70,000 pound force for the hemming. The number of drives used with their location and size will depend upon the sheet metal part being hemmed and the optimization of the cycle.

With the moving and compacting component machine being the work carrying anvil, it is necessary to move the shoe or steel die members into and out of alignment with the anvil. In the present invention this is accomplished by horizontal reciprocation of a carriage 38 on which the compound die 20 is located. Carriage 38 has a lower slide member 40 which slides against slide member 42 attached to machine frame base 44. The carriage slide member 40 is guided by gib blocks 46 on each side of the carriage, one of which is seen in FIG. 1.

Figure 6:
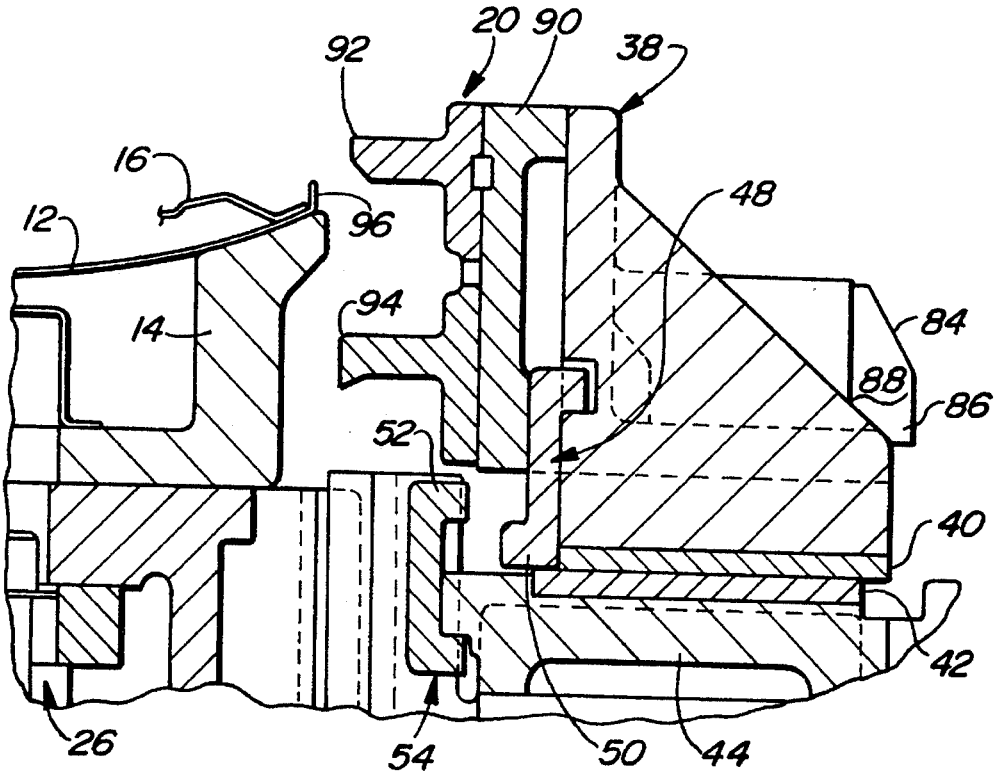
FIGS. 6–9 are partial elevational views showing the anvil and the flanging and hemming die in sequential positions to form the hem.

The carriage 38 is moved between a rest position, shown in FIG. 6 in which the compound die 20 is out of vertical alignment with the anvil 14, and a work position shown in FIGS. 1–3 and 7–9 in which the compound die is in vertical alignment with the anvil 14. Carriage 14 has a depending stop member 48 with a horizontal locking leg 50 which coacts with a horizontal locking leg 52 of locking channel 54 connected to base 44 when the carriage is moved into its work position. This prevents any upward deflection of the carriage when the die is then impacted by the anvil 14.

Figure 5:
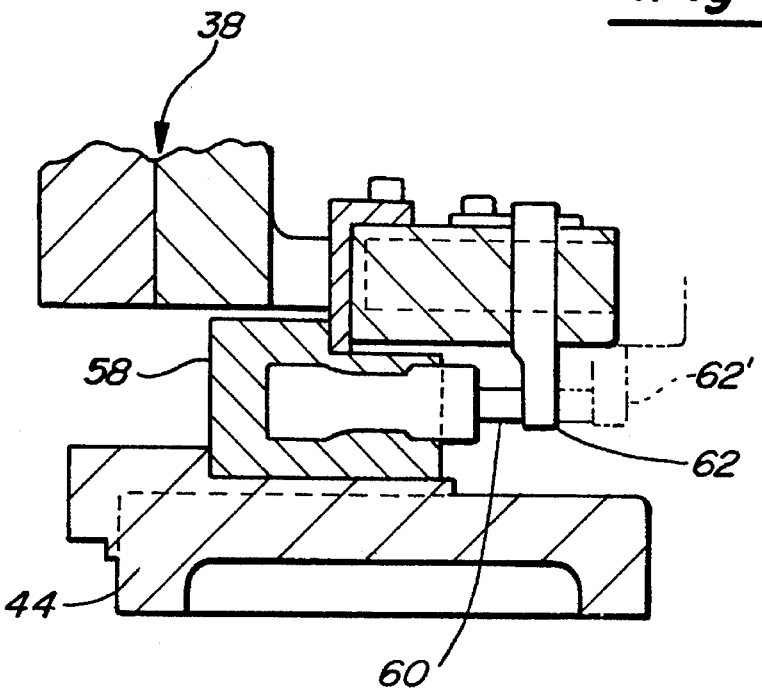
FIG. 5 is a partial plan sectional view of a portion of the mechanism of FIG. 4 showing the air biasing cylinder.

Carriage 38 is biased into its rest position by air cylinder 58 attached to base 44 with the cylinder piston rod 60 pushing against carriage strut member 62. The rest position of the carriage strut 62 is shown in phantom at 62' in FIG. 5.

Movement of the carriage 38 between its rest position and its work position is obtained by linear motor 64 attached to the machine frame 66. Rotation of the threaded rod 68 of motor 64 in nut member 70 attached to slide 72 moves the slide vertically. Spaced way members 74 on the slide 72 guide the vertical movement of slide 72 in stationary guides 76.

Figure 4:
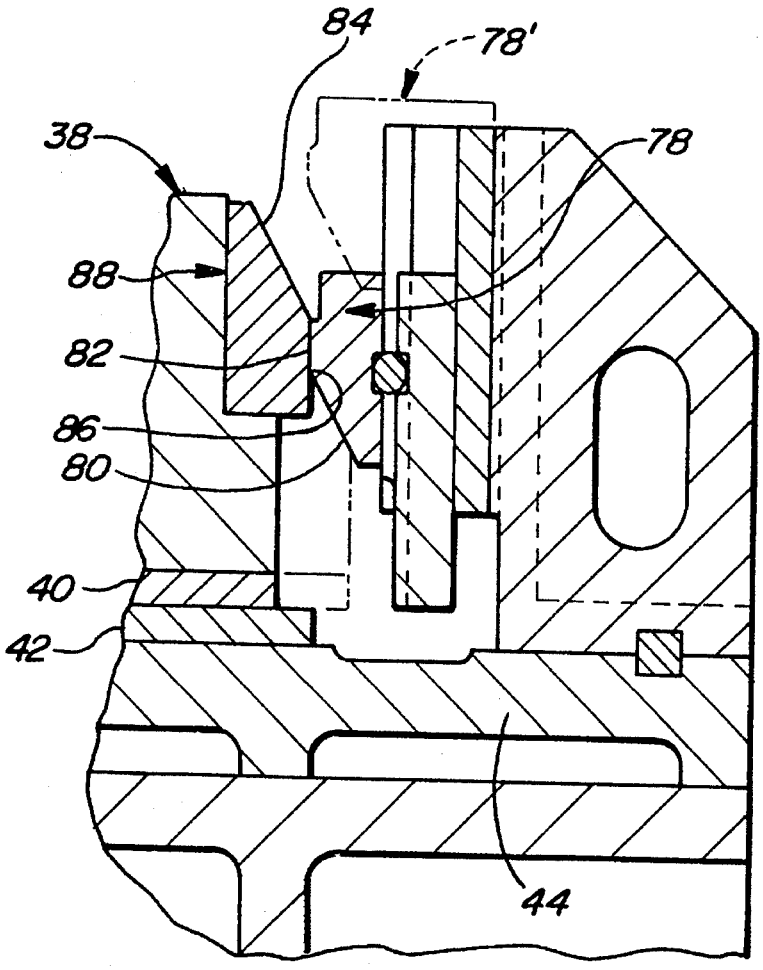
FIG. 4 is a partial elevational view taken along line 4—4 of FIG. 2 showing the horizontal slide cam moving member.

Attached to each way member 74 is a cam 78. Cam 78 has a sloped ramp portion 80 and a vertical stop portion 82 which act respectively against the sloped portion 84 and a vertical stop portion 86 of cam follower 88 which is attached to the carriage 38. When the cam is in its upper position indicated at 78' in FIG. 4, the carriage 38 is in its rest position with the pressure in cylinder 58 maintaining it in this position as indicated by the carriage strut member 62' shown in phantom.

When the linear motor 64 is actuated to lower the slide 72 through threaded rod 68 and nut member 70, the ramp portion 80 of cam 78 slides against the slope portion 84 of the cam follower 88 moving the carriage into its work position. When the carriage is in its work position, it will be locked in this horizontal position by the coaction of the cam and follower vertical stop portions 82 and 86.

The carriage 38 carries the compound die 20 which includes a facing plate 90 carrying an upper flanging die 92 and a lower hemming die 94. In FIG. 3 the carriage 38 has been moved horizontally to the left to bring the flanging portion 92 of the compound die 20 into alignment with the anvil 14 for performing the first, flanging, operation which will bend upstanding peripheral portion 96 of the outer sheet metal panel 12 into a flange having an acute angle with the panel 12. After this flange has been formed the carriage 38 will be moved to the right so that both the upper and lower die sets of the compound die will assume the position shown in phantom in FIG. 3 at 92' and 94'. Likewise the anvil will be moved through actuation of the servo motor drive 26 to a lower position shown in phantom at 14' so that the hemming die 94 can be slid into alignment with the anvil as will be explained.

As can be seen in FIGS. 1–3 a roller conveyor 98 having a plurality of spaced aligned rollers 100 can be moved from a position below the anvil 14 as shown in FIG. 3 to a position shown in phantom at 98' in FIG. 3 above the anvil 14. This motion is accomplished by air cylinder 102 and guides 104. When the conveyor is moved to a position above the anvil 14, as shown at 98' in FIG. 3, it is in a load-discharge position so that, initially, the sheet metal panels to be joined are loaded onto the conveyor as shown in phantom at 12' and 16'. The conveyor is then lowered by the air cylinder 102 into the open interior of the machine to the position below the anvil 14 depositing the sheet metal parts 12 and 16 on the anvil.

OPERATION OF THE MACHINE

It will be apparent that a single hem or multiple hems may be simultaneously formed by the hemming machine 10. As indicated previously, the illustrated embodiments contemplates the simultaneous formation of four edge hems on a automotive hood which involves the use of four complete servo motor drives 26, one at each corner of the platen 14, and the use of four carriages 38 with their compound dies 20 and associated operating elements. In the following description reference is made to a single station for convenience only.

The roller conveyor in its upper load and discharge position is shown in phantom at 98' in FIG. 3. The sheet metal part, embracing outer sheet metal panel 12 and inner sheet metal panel 16, is placed on the roller conveyor in the position indicated in phantom at 12' and 16' in FIG. 3. The roller conveyor 98 is lowered by operation of air cylinder 102 to a position below the anvil 14, transferring the panels to the anvil. During this transfer the carriage 38 and its compound die 20 is in its rest position as shown in FIG. 6 so that the parts will clear the die as they are being loaded onto the anvil 14.

Figure 7:
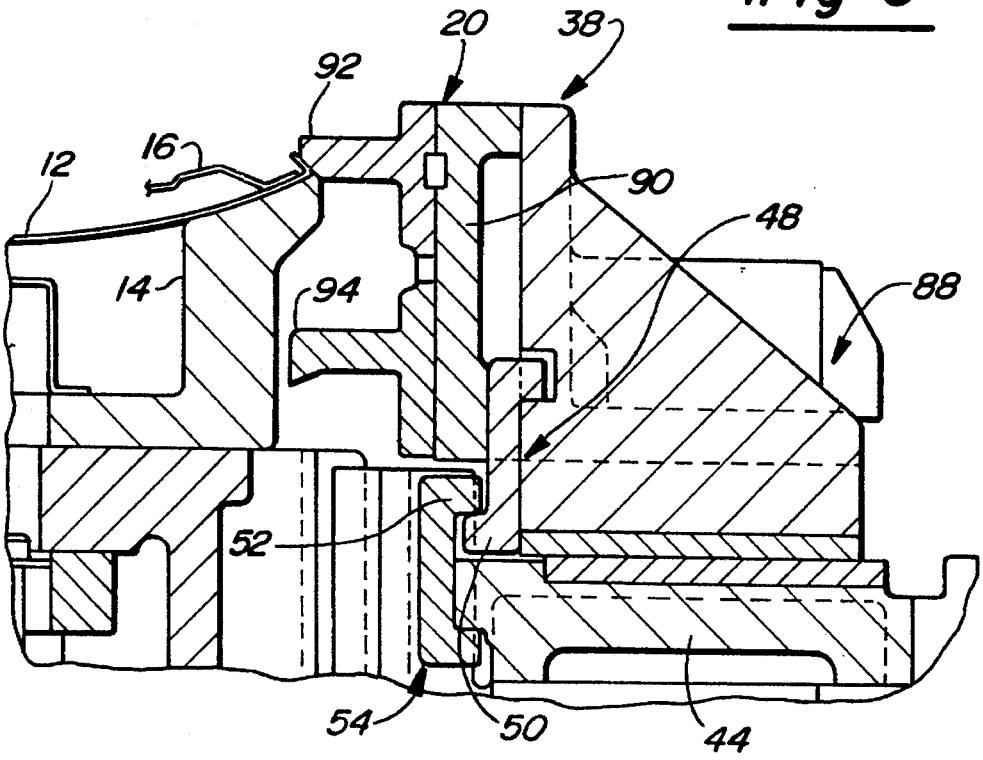

The anvil 14 is also shown in a vertical position for alignment of the flanging portion 92 of the die with the anvil. The carriage 38 is then horizontally moved to the left to the position seen in FIG. 3 to align the flanging portion 92 of the die 20 with the anvil 14 by the mechanism previously described in which the carriage is horizontally and vertically locked into this position allowing sufficient distance between the anvil 14, holding the parts 12 and 16, and the flanging die 92 to allow the servo motor drive 26 to accelerate upward movement of the anvil to impact the upstanding peripheral edge 92 of the panel 12 between the anvil 14 and the flanging die 96 as shown in FIG. 7.

Figure 8:
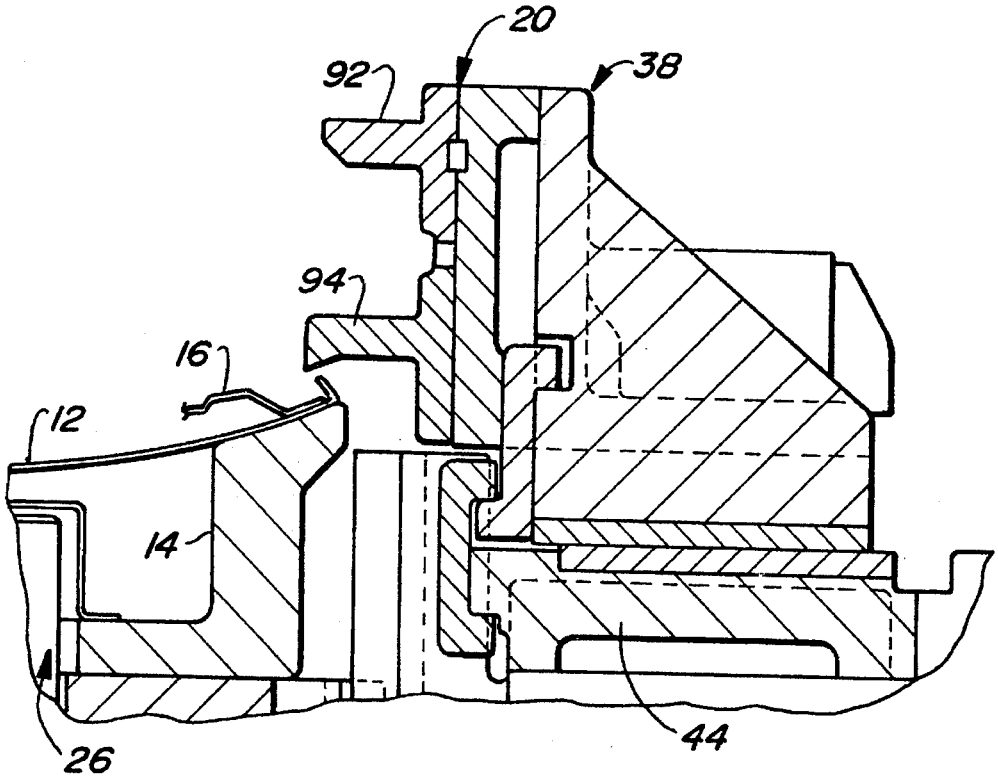
Figure 9:
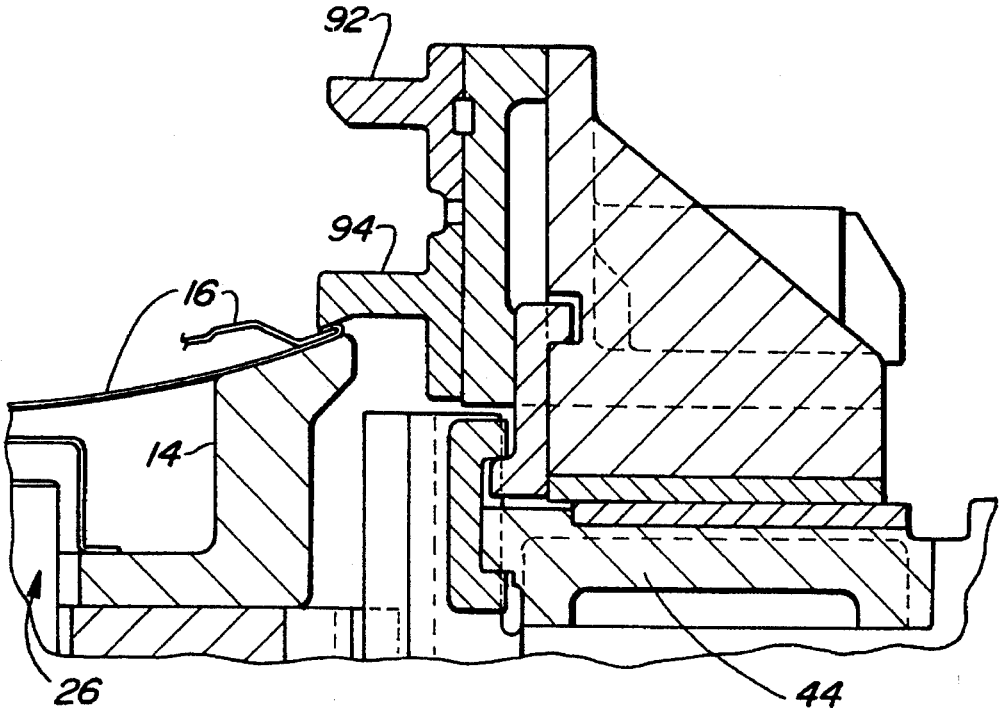

The carriage 38 is then moved to its rest position shown in FIG. 6, and the anvil is lowered to a position below the hemming die 94, a sufficient distance for the impact stroke of the anvil by the servo motor drive 26 to form the hem. The carriage 38 is then moved into its work position as shown in FIG. 8 with the hemming die 94 vertically aligned with the anvil 14 and the flange formed at the peripheral edge 96 of the sheet metal panel 12. The servo drive 26 is then actuated to impact the flange at 96 to hem the panels 12 and 16 together as shown in FIG. 9. The anvil 14 is then lowered so that the finished hem is clear of the hemming die 94 permitting the carriage 38 to be moved to its rest position as indicated in FIG. 6. The roller conveyor then is raised from a position below the anvil to its charge and discharge position above the anvil as indicated at 98', 100' in FIG. 3 so that the finished part can be removed. The cycle is then repeated starting with the movement of the anvil to a position below the flanging die 92.

It has been found that the novel use of an electric servo motor drive in the hemming machine of this invention permits a significantly shorter time cycle and provides greater accuracy over hemming machines using hydraulic, pneumatic or flywheel powered drives at substantial cost saving. Vertically positioning and driving the work supporting platen or anvil against horizontally positioned flanging and hemming dies has also contributed to the accuracy and has reduced cycle time as well as projected maintenance requirements.

The embodiments of the invention in which an exclusive property is claimed are defined as follows:

What is claimed is:

1. A sheet metal hemming machine comprising:

an anvil for supporting the sheet metal part to be hemmed;

a linear actuator for vertically moving said anvil;

a controllable electric motor operatively connected to said actuator;

flanging and hemming die means;

means for moving said die means into and out of registry with said anvil; and wherein successive operation of said motor causes successive upward movements of said anvil to impact said sheet metal part between said anvil and said die means to form a flange and to impact said flange between said anvil and said die to form a hem, wherein said linear actuator is a ball screw.

2. The hemming machine according to claim 1 wherein a gear reducer is interposed between said controllable electric motor and said ball screw.

3. The hemming machine according to claim 1 further including a roller conveyor which is vertically movable between an upper load and discharge position above said anvil, wherein said sheet metal part is loaded onto said conveyor, to a lower position below said anvil, transferring said sheet metal part from said conveyor to said anvil, and said roller conveyor is movable between said lower position to said upper load and discharge position, picking up the sheet metal part having been hemmed to be discharged at said upper position.

4. The sheet metal hemming machine according to claim 1 wherein a plurality of horizontally spaced linear actuators are attached to said anvil, each actuator being operatively connected to one of a plurality of dc servo motors for synchronous drive of said motors to move said anvil vertically.

5. The hemming machine according to claim 4 including a plurality of flanging and hemming die means and a plurality of means for moving said plurality of die means into and out of registry with said anvil for simultaneously forming a plurality of flanges and simultaneously forming said flanges into hems on said sheet metal part.

6. The hemming machine according to claim 1 wherein said moving means for said die means includes a horizontally movable carriage on which said flanging and hemming die means is located and means for horizontally shifting said carriage between a rest position in which said die means is out of alignment with said anvil and a work position in which said die means is in alignment with said anvil.

7. The hemming machine according to claim 6 wherein said flanging and hemming die means includes an integral compound die, said compound die being mounted on a single horizontally movable carriage for horizontally shifting said carriage between said rest position and said work position in which one of a flanging portion and a hemming portion of said compound die is in alignment with said anvil.

8. A sheet metal hemming machine comprising:

an anvil for supporting the sheet metal part to be hemmed;

a linear actuator for vertically moving said anvil;

a controllable electric motor operatively connected to said actuator;

flanging and hemming die means;

means for moving said die means into and out of registry with said anvil; and wherein successive operation of said motor causes successive upward movements of said anvil to impact said sheet metal part between said anvil and said die means to form a flange and to impact said flange between said anvil and said die to form a hem;

a roller conveyor which is vertically movable between an upper load and discharge position above said anvil, wherein said sheet metal part is loaded onto said conveyor, to a lower position below said anvil, transferring said sheet metal part from said conveyor to said anvil, and said roller conveyor is movable between said lower position to said upper load and discharge position, picking up the sheet metal part having been hemmed to be discharged at said upper position.

9. The hemming machine according to claim 8 wherein said linear actuator is a ball screw, and wherein a gear reducer is interposed between said controllable electric motor and said ball screw.

10. The sheet metal hemming machine according to claim 8 wherein a plurality of horizontally spaced linear actuators are attached to said anvil, each actuator being operatively connected to one of a plurality of dc servo motors for synchronous drive of said motors to move said anvil vertically.

11. The hemming machine according to claim 10 including a plurality of flanging and hemming die means and a plurality of means for moving said plurality of die means into and out of registry with said anvil for simultaneously forming a plurality of flanges and simultaneously forming said flanges into hems on said sheet metal part.

12. The hemming machine according to claim 8 wherein said moving means for said die means includes a horizontally movable carriage on which said flanging and hemming die means is located and means for horizontally shifting said carriage between a rest position in which said die means is out of alignment with said anvil and a work position in which said die means is in alignment with said anvil.

13. The hemming machine according to claim 12 wherein said flanging and hemming die means includes an integral compound die, said compound die being mounted on a single horizontally movable carriage for horizontally shifting said carriage between said rest position and said work position in which one of a flanging portion and a hemming portion of said compound die is in alignment with said anvil.

* * * * *